US009782030B1

(12) United States Patent
Bell et al.

(10) Patent No.: US 9,782,030 B1
(45) Date of Patent: Oct. 10, 2017

(54) HANGER SPACER APPARATUS AND METHOD

(71) Applicant: Xangar LLC, Telluride, CO (US)

(72) Inventors: Brittany D. Bell, Mountain Village, CO (US); Deborah Nichols Peacock, Mountain Village, CO (US); Gary Cantor, Telluride, CO (US); Andrew Valentine, Denver, CO (US)

(73) Assignee: Xangar LLC, Telluride, CO (US)

( * ) Notice: Subject to any disclaimer, the term of this patent is extended or adjusted under 35 U.S.C. 154(b) by 0 days.

(21) Appl. No.: 14/937,144

(22) Filed: Nov. 10, 2015

Related U.S. Application Data

(60) Provisional application No. 62/078,256, filed on Nov. 11, 2014.

(51) Int. Cl.
*A47G 25/14* (2006.01)
*F16B 2/22* (2006.01)

(52) U.S. Cl.
CPC ..... *A47G 25/1471* (2013.01); *F16B 2/22* (2013.01)

(58) Field of Classification Search
CPC ..... A47K 10/12; A47K 10/14; A47H 13/01; A47G 25/0692; A47G 25/32; A47G 25/325; A47G 25/1471; A47G 25/145; A47G 25/14; A47G 25/1407; A47G 25/1421; A47G 25/183; A47G 25/186; F16B 2/22
USPC ..... 211/113, 123; 223/85; D6/328
See application file for complete search history.

(56) References Cited

U.S. PATENT DOCUMENTS 2,058,416 A * 10/1936 Comstock ..... A47K 10/04 16/109
2,510,043 A * 5/1950 Tillery ..... A47G 25/26 223/88
3,482,746 A * 12/1969 Ferguson ..... A47G 25/32 223/85
3,527,358 A * 9/1970 Wheeler ..... A47G 25/32 211/119
4,415,093 A * 11/1983 Livingston ..... A47G 25/0692 16/87.2
4,548,328 A * 10/1985 Brauning ..... A47F 7/24 211/123
4,577,766 A * 3/1986 Miller ..... A47G 25/0692 211/113
4,760,929 A * 8/1988 Fedorchak ..... A47F 7/24 211/105.1
4,971,210 A * 11/1990 Blumenkranz .... A47G 25/0692 211/105.1
D423,799 S * 5/2000 Sorensen ..... D20/22
D438,450 S * 3/2001 Jones ..... D8/376
6,488,159 B2 * 12/2002 Shuen ..... B60R 7/10 211/105.3
7,216,786 B2 * 5/2007 Mikhail ..... A47G 25/26 223/85
D617,566 S * 6/2010 Barnes, Jr. ..... D6/328

(Continued)

*Primary Examiner* — Patrick Hawn
(74) *Attorney, Agent, or Firm* — Staniford Tomita LLP

(57) ABSTRACT

Hanger spacers are placed on a clothing rod to separate clothing hangers so that the articles of clothing supported by the hangers are not compressed against each other. The hanger spacers can have a cylindrical outer surface and planar side surfaces. A slot can extend from the outer surface to an inner cylindrical surface. The hanger spacer can be made of an elastic material. The slot of the hanger spacer can narrower than the clothing rod. The hanger rod can be pressed through the slot into the inner diameter.

20 Claims, 20 Drawing Sheets

(56) References Cited

U.S. PATENT DOCUMENTS

| | | | | | |
|---|---|---|---|---|---|
| D638,228 | S | * | 5/2011 | Chim | D6/328 |
| D692,677 | S | * | 11/2013 | Dotson | D6/328 |
| 2012/0199617 | A1 | * | 8/2012 | Arceo | A47G 25/20 223/85 |

* cited by examiner

HANGER SPACER APPARATUS AND METHOD

CROSS REFERENCE TO RELATED APPLICATIONS

This application claims priority to U.S. Provisional Patent Application No. 62/078,256, "Hanger Spacer Apparatus And Method" filed Nov. 11, 2014 which is incorporated by reference in its entirety.

BACKGROUND

When not being worn, clothing is frequently placed on hangars, which are placed on a rod for storage in a closet. There are various types of clothes hangers. Wire hangers have a simple flattened triangle shaped lower portion that continues into a hook at a top portion. Wooden hangers consists of a piece of wood cut into a boomerang-like shape with the edges sanded down to prevent damage to the clothing, and a hook, usually of metal, protruding from the point. Some wooden hangers have a rounded bar that can extend horizontally from side tip to side tip, forming a lower side of a triangle that can be used to hang pants. Plastic hangers, can have the same shape of a wire or wooden hanger. Clean clothing can be placed on a hanger and the hook portion of the hanger can be placed on a clothing rod, which is normally suspended a few feet off the ground spaced away from a wall in a horizontal orientation.

When a user needs to remove the clothing from the hanger, the user can slide the clothing on the rail adjacent to the clothing of interest so that the person can see the clothing. The user can then remove the hanger from the clothing rod and then remove the clothing from the hanger. A problem with storing clothing stored on a clothing rod is that the adjacent clothing can be pressed against each other. This compression contact can cause wrinkling or compression of the clothing or result in lint or other material being transferred. Thus, this contact can result in degrading the appearance of the clothing. The spacing between clothes hangers also prevents clothing from getting lost when pressed between adjacent clothing. What is needed is a system for separating clothing hangers so that the clothing stored on the hangers will have sufficient space and will be clearly visible on a clothes rod.

SUMMARY OF THE INVENTION

The present invention is directed towards various embodiments of hanger spacers which can be easily placed on clothing rods or cables between adjacent clothing hangers. The hanger spacers can have a body made of an elastic material and have a substantially circular shape. However, in other embodiments, the hanger spacer bodies can be any other geometric shape. The hanger spacer body can have substantially planar side surfaces which can be approximately perpendicular to the clothing rod or cable when the hanger spacer is being used. The center portion of the hanger spacer body can have a hole with an inner diameter that can be sized to be slightly larger than the clothing rod or cable. A slot can be formed in the body of the hanger spacer which intersects the hole. The side surfaces of the slot can be rounded and tapered so that the slot surfaces are smooth and do not include any sharp surfaces. However, in some embodiments, the hanger spacer may not include a slot and the hole can be completely surrounded.

In different embodiments, the hanger spacer can have various physical characteristics. For example, the body of the hanger spacer can be made of: foam, plastic, paper, metal, composite, wood or any suitable material or combination of materials. The hanger spacer can be fabricated by various manufacturing methods including: molding, machining, stamping, 3D printing, etc. In an embodiment, the hanger spacer can be made from injection-molded foam. In another embodiment, the hanger spacer can be formed from a foam body that can be sandwiched between two side surface pieces. In other embodiments, the hanger spacer can be molded from elastic plastic materials. The hanger spacer body can have recessed or hollow surfaces. In order to allow the hanger spacer to slide easily over the clothing rod or cable, the inner surfaces of the hole can be convex across the thickness of the hanger spacer. The outer diameter of the hanger spacer can also be convex across the thickness. However, since the outer diameter does not alter the functionality, this surface can alternatively be concave across the thickness.

In an embodiment, the user can install the hanger spacers on a clothing rod by placing the slot portion of the hanger spacer against the clothing rod. The user can press the hanger spacer against the clothing rod so that the clothing rod slits through the slot to the center hole. Because the hanger spacer can be made of an elastic material, the side portions of the body can separate during this process. Once the rod is in the hole, the side portions of the body can return to their normal shapes. If the hanger spacer is being placed on a cable, the side portions may not deflect significantly when the hanger spacer is placed on the cable.

The hole in the hanger spacer body can be off set from a center axis of the body. Thus, the clothing rod may not be concentric with the outer diameter of the clothing hanger. In an embodiment, the hole can be located on an upper portion of the hanger spacer. This offset of the hole can cause the center of gravity to be on a lower portion of the hanger spacer. When the hanger spacer is placed on the clothing rod or cable, the offset center of gravity can cause the hanger spacer to automatically rotate into an upright position on the clothing rode or cable. This can improve the uniform appearance of multiple hanger spacers used on a clothing rod.

In some embodiments, the hanger spacer can have a two piece design which can fit together to surround the clothing rod. In an embodiment, the two pieces can each be semicircular in shape with each piece having a portion of the hole. The pieces can be coupled with a hinge on one side and a coupling device on the opposite side. The hanger spacer can be opened at the hinge to place the hanger spacer on the clothing rod. The hanger spacer can then be closed and the coupling device can be actuated to secure the hanger spacer to the clothing rod.

In another two piece embodiment, a first piece can surround more than 50% of the clothing rod and the second piece that can slide against the first piece. In a first position, the second piece can be moved to a position that opens a slot to the hole in the hanger spacer so the hanger spacer can be placed on the clothing rod or cable. The second piece can then be moved to close the slot opening to surround the clothing rod and prevent the hanger spacer from being removed.

DETAILED DESCRIPTION

Figure 1:
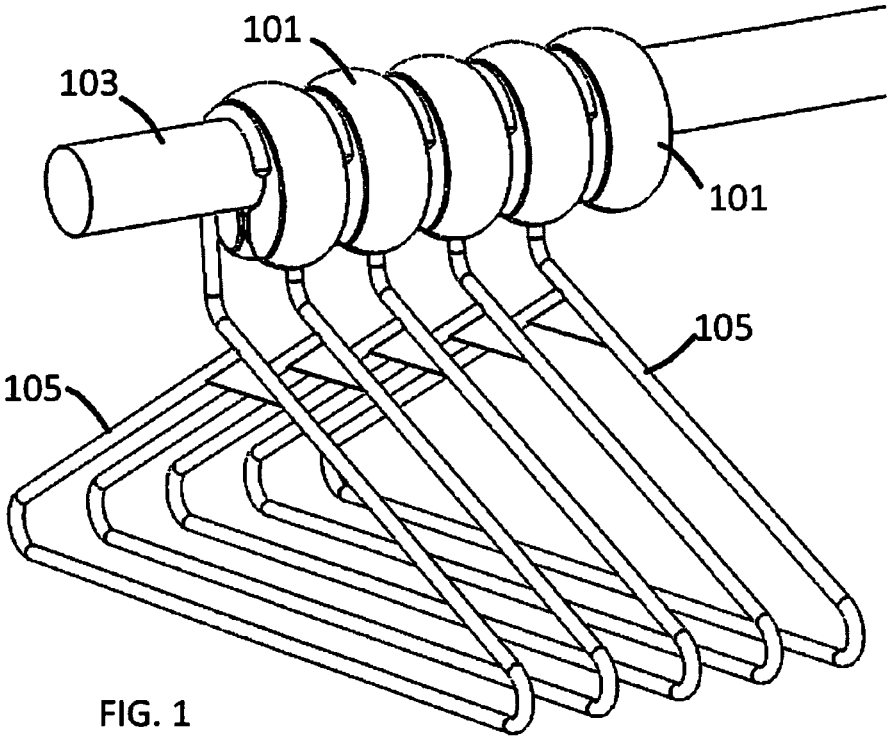
FIG. 1 illustrates a perspective view of a plurality of hanger spacers placed on a clothing rod between adjacent clothing hangers.
Figure 2:
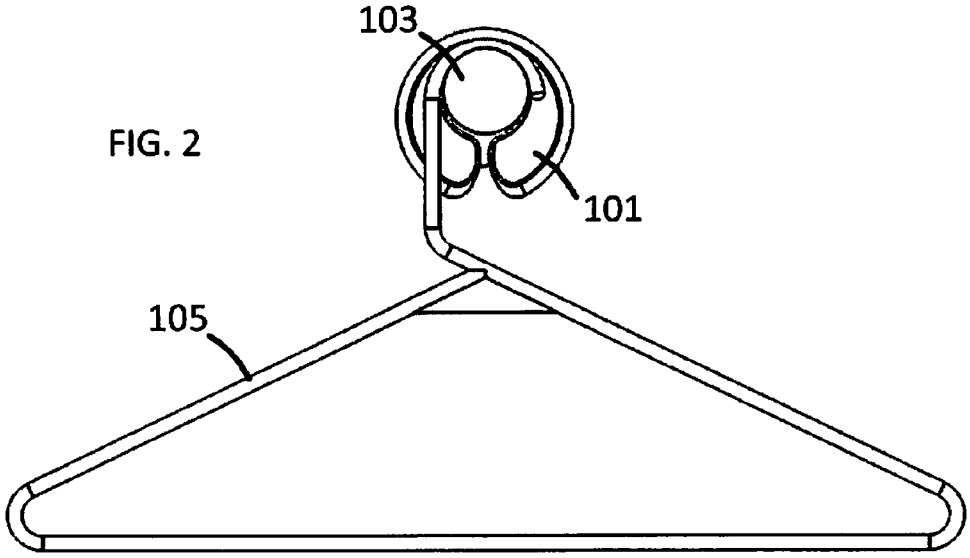
FIG. 2 illustrates a front view of a hanger spacers placed on a clothing rod adjacent to a clothing hanger.

With reference to FIGS. 1 and 2, the present invention is directed towards hanger spacers 101 which are placed on the clothing rod 103 between each of the clothes hangers 105. By separating the clothes hangers 105 by the thickness of the hanger spacers 101, the clothing stored on the clothes hangers 105 will not contact each other. Even if the clothes hangers 105 are slid across the clothing rod 103, the hanger spacers 101 will maintain a space between the clothes hangers 105. When the sliding movement is complete, the hanger spacers 101 will prevent the clothes on the clothes hangers 105 from compressing against each other.

In an embodiment, the hanger spacers can have a thickness of 0.5 inch or greater. Thus, when placed between each of the hangers 105, the hanger spacers 101 will maintain a space equal to the thickness of the hanger spacers 101. This spacing may be appropriate for thin clothing such as pressed shirts. However, other types of clothing may require more space between hangers. In other embodiments, the space between the hangers 105 can be adjusted by placing more than one hanger spacer 101 between adjacent hangers 105 or by using thicker hanger spacers 101. For example a suit will be made of constructed from more layers of thicker material than a shirt. Thus, a suit may require much more space on a clothes rod than a pressed shirt. In an embodiment, it is possible to expand the distance between multiple hangers by placing two or more hanger spacers between the hangers. In some embodiments, multiple hanger spacers can be coupled together with connection mechanisms. The connection mechanisms can include magnets, hook and loop connectors or any other suitable type of connectors. These embodiments will be described below.

Figure 3:
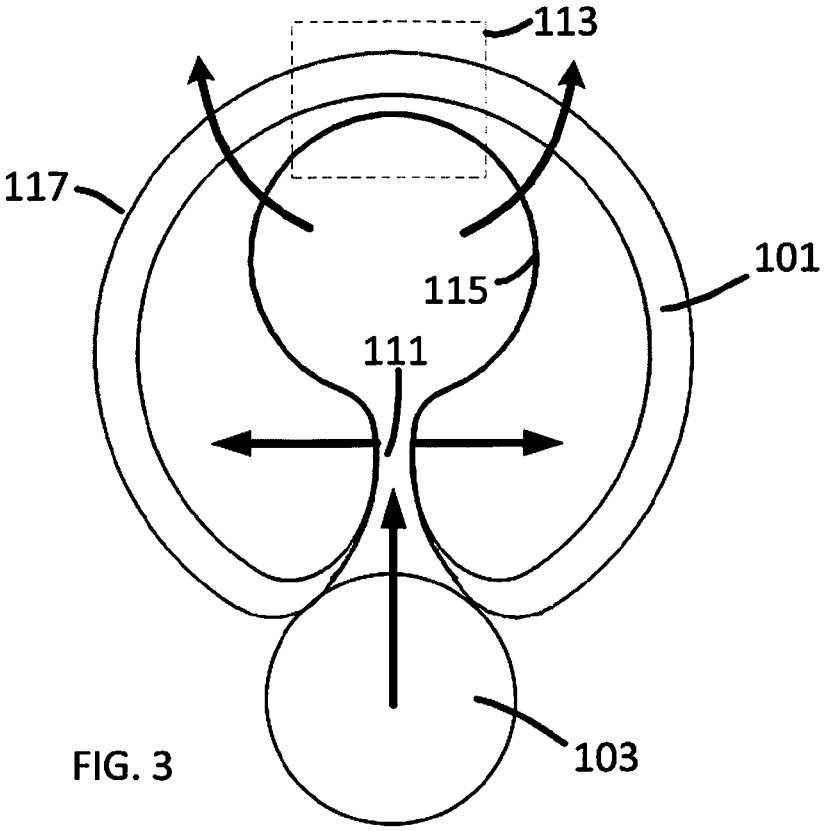
FIG. 3 illustrates a front view of a hanger spacer being placed on a clothing rod.

With reference to FIG. 3, in an embodiment, the clothing hanger spacer 101 has a cylindrical outer surface 117 and the distance between the side surfaces of the hanger spacer can define the thickness of the hanger spacer 101. The cross section of the hanger spacer 101 can have a "C" shaped with an inner concave surface 115. In an embodiment the inner concave surface 115 can be cylindrical. However, in other embodiments, the inner concave surface 115 can be any other geometric shape. For example, the inner concave surface can have a hexagonal cross section. A slot 111 extends between the outer surface 117 and the inner surface 115 of the hanger spacer 101 and the width of the slot 111 can be narrower than the diameter of the clothing rod 103 so that the hanger spacer 101 cannot fall off of the clothes rod 103. The diameter of the inner cylindrical surface 115 is larger than the outer diameter of the clothing rod 103 so the hanger spacer 101 can rotate on the clothing rod 103. The inner surfaces 115 and the slot 111 of the hanger spacer 101 can also be made of a smooth material having a low coefficient of friction so that the clothing spacer 101 can easily be placed on the clothes rod 103 and removed from the clothes rod 103. The low coefficient of friction can also allow the hanger spacer 101 to rotate into an upright when it is placed on the clothing rod 103.

With reference to FIG. 3, the hanger spacers 101 can be put on the clothing rod 103 by pressing the slot 111 opening against the clothing rod 103. The hanger spacer 101 can be made of an elastic material such as plastics which can be polyurethane, ethylene vinyl acetate (EVA), acrylonitrile butadiene styrene (ABS), polypropylene and/or rubber materials. The movement of the clothing rod 103 into the slot 111 can cause the hanger spacer 103 to elastically deform so that the slot 111 width expands to allow the width of the slot 111 to expand so that the rod 103 can slide into the inner concave surface 115. For example, the ends of the "C" shape cross section of the hanger spacer 101 can tapered and rounded corners. When the circular cross section clothing rod 103 is placed against the slot 111, the ends of the hanger spacer 101 can separate so that the slot 111 width expands. The thinnest portion of the hanger spacer 101 can be a top portion 113 that can elastically bend and deform when the slot 111 between the ends of the "C" portion expands as the clothes rod 103 passes through.

Figure 4:
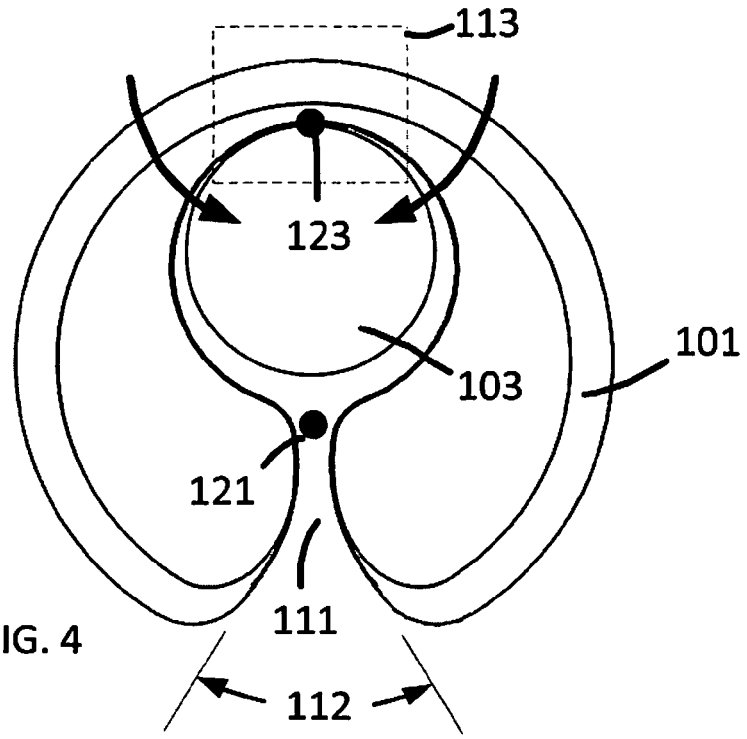
FIG. 4 illustrates a front view of a hanger spacer after it has been placed on a clothing rod.

With reference to FIG. 4, once the hanger spacer 101 is placed on the clothing rod 103 within the inner cylindrical volume, the hanger spacer 101 will elastically assume it's original shape. The top portion 113 of the hanger spacer 101 can bend back to its original shape and the slot 111 can come back to its original width. When a user wants to remove the hanger spacer 101 from the clothes rod 103, the user can grasp the hanger spacer 101 and rotate it so that the center axis of the concave cylindrical section of the hanger spacer 101 is misaligned with the clothes rod 103. This rotation can force the clothes rod 103 through the slot 111 on one side of the hanger spacer 101. This movement can cause the hanger spacer 101 to deform and the clothes rod 103 to pass through the expanded slot 111.

Clothes rods 103 can have a diameter of about 0.25 to 1.5 inches. The inner diameter of the hanger spacer 101 can have a diameter of about 0.62 to 1.32 inch, which is preferably larger than the diameter of the clothes rod 103, so that the hanger spacer 101 can rotate freely on the clothes rod 103. The outer width (or diameter of cylindrical embodiments) of the hanger spacer can be between about 1.5 to 4 inches. The slot 111 in the hanger spacer 101 can have a width that is narrower than the diameter of the clothing rod 103 that can prevent the hanger spacer 101 from accidentally falling off of the clothing rod 103. The slot 111 can have a tapered shape, which can define an angle 112 between about 30 to 80 degrees. The radius of the rounded corners of the hanger spacer 101 can be about 0.25 to 0.75 inch. As discussed above, the thickness of the hanger spacer 101 can be about 0.5 to 1.5 inches or more.

Figure 5:
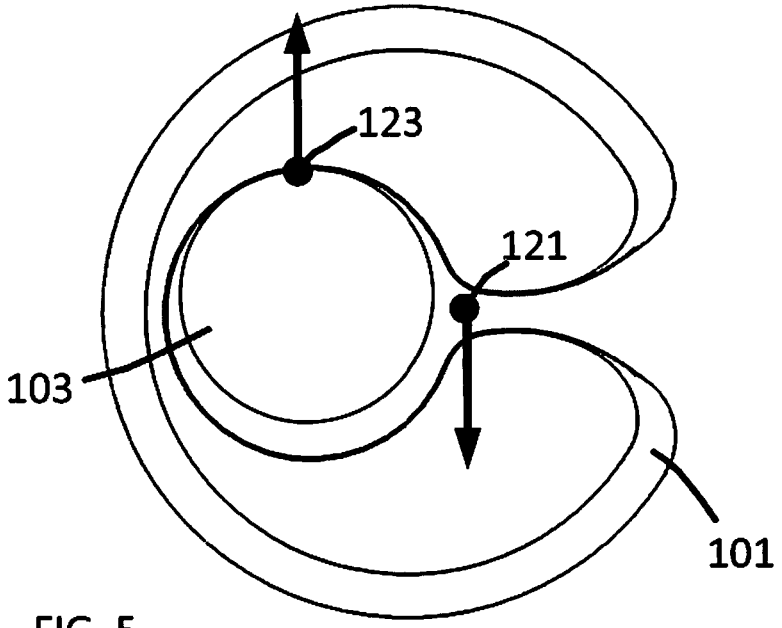
FIGS. 5 and 6 illustrate front views of the hanger spacer in sideways positions on the hanger spacer and the gravitations forces applied to the hanger spacer.
Figure 6:
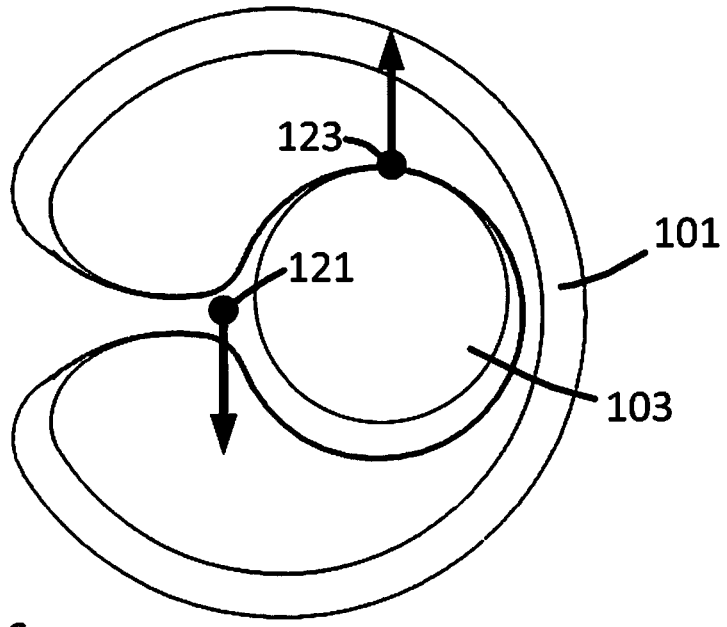

The hanger spacer 101 can have a center of gravity 121 that is lower than the geometric center of the hanger spacer 101. The hanger spacer 101 can rest on a point 123 under the top portion 113 of the hanger spacer 101. When the hanger spacer 101 is placed on the clothes rod 103, the hanger spacer 101 will rotated to an upright position with the center of gravity 121 directly below the point of contact 123 of the hanger spacer 101 with the clothes rod 103. For example with reference to FIGS. 5 and 6 when the hanger spacer 101 is placed on a clothes rod 103 in a sideways position, the clothes rod 103 will vertically support the hanger spacer 123 at a contact point 123 and a downward gravitational force will be applied to the center of gravity 121 of the hanger spacer 123. In FIG. 5 the applied forces will cause the hanger spacer 101 to automatically rotate clockwise on the clothes rod 103 into an upright position with the center of gravity 121 directly below the contact point 123 as shown in FIG. 4 and conversely the forces illustrated in FIG. 6 will cause the hanger spacer 101 to automatically rotate counter clockwise on the clothes rod 103 into an upright position.

Figure 7:
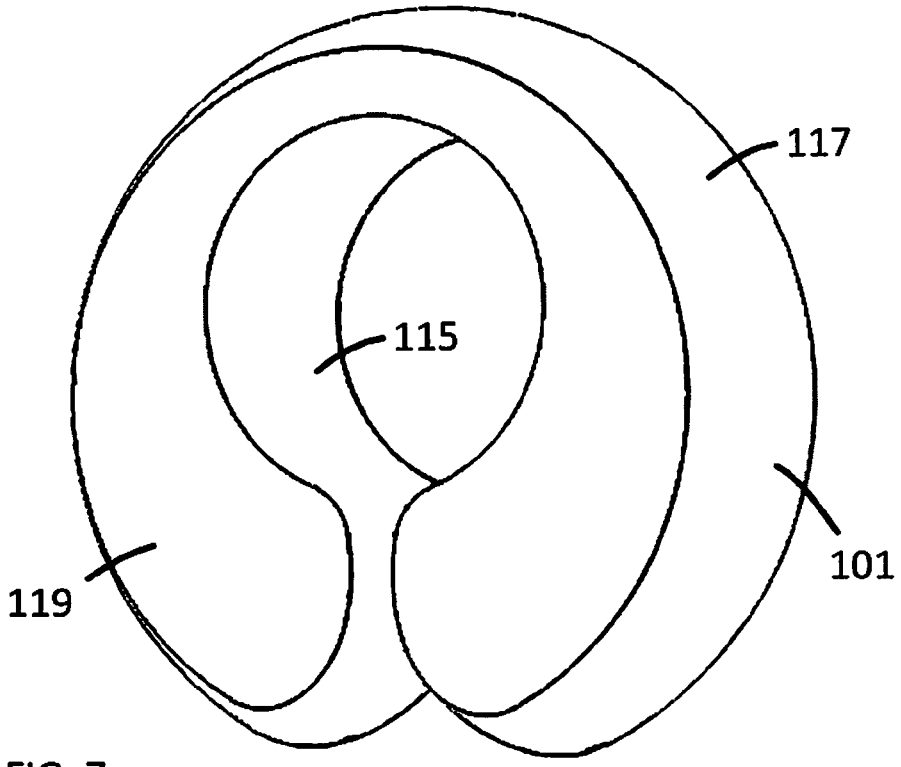
FIG. 7 illustrates a perspective view of an embodiment of a solid foam embodiment of the hanger spacer.
Figure 8:
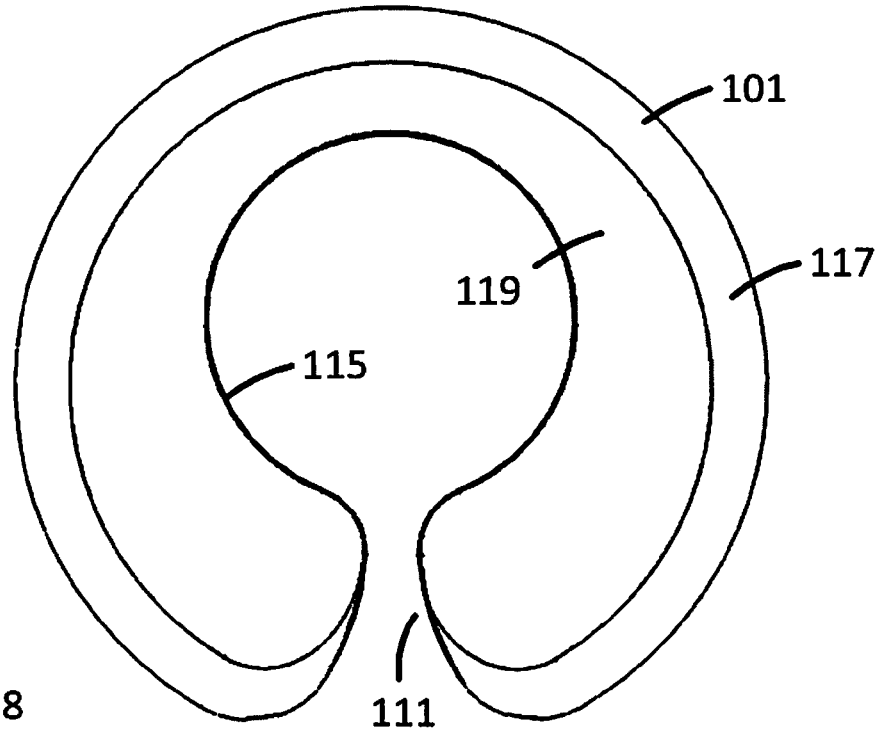
FIG. 8 illustrates a front view of an embodiment of a solid foam embodiment of the hanger spacer.

The clothing hanger spacers can have various different constructions and configurations. With reference to FIG. 7 a perspective view of an embodiment of the hanger spacer 101 is illustrated and FIG. 8 illustrates a side view of the embodiment of the hanger spacer 101 is illustrated. In an embodiment, the hanger spacer 101 can be made of a homogeneous elastic material. For example, in an embodiment, the hanger spacer 101 can be made of an elastic foam material. The side surfaces 119 of the hanger spacer 101 can be planar. The outer perimeter surface 117 can be a convex curved surface that extends between the side surfaces 119. The inner surface 115 can be a concave cylindrical surface. In an embodiment the inner surface 115 can be convex between the two side surfaces with the apex of the convex curve is approximately at a center cross section portion of the hanger spacer. The hanger spacer may only contact the clothes rod at the upper portion of the inner surface at the apex of the convex curvature between the side surfaces.

Figure 9:
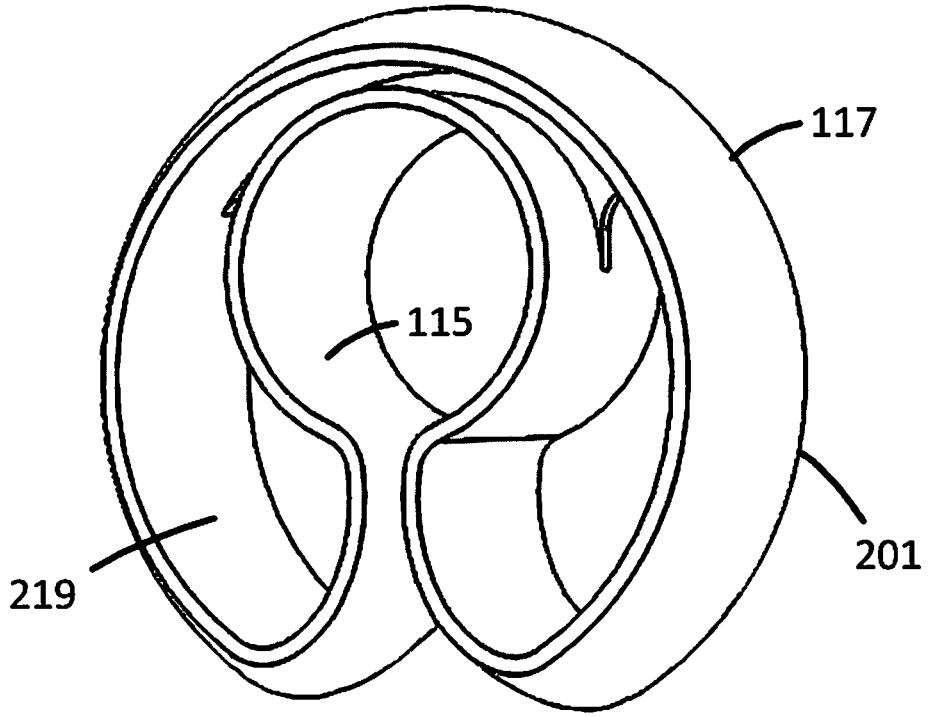
FIG. 9 illustrates a perspective view of a hollow embodiment of the hanger spacer.
Figure 10:
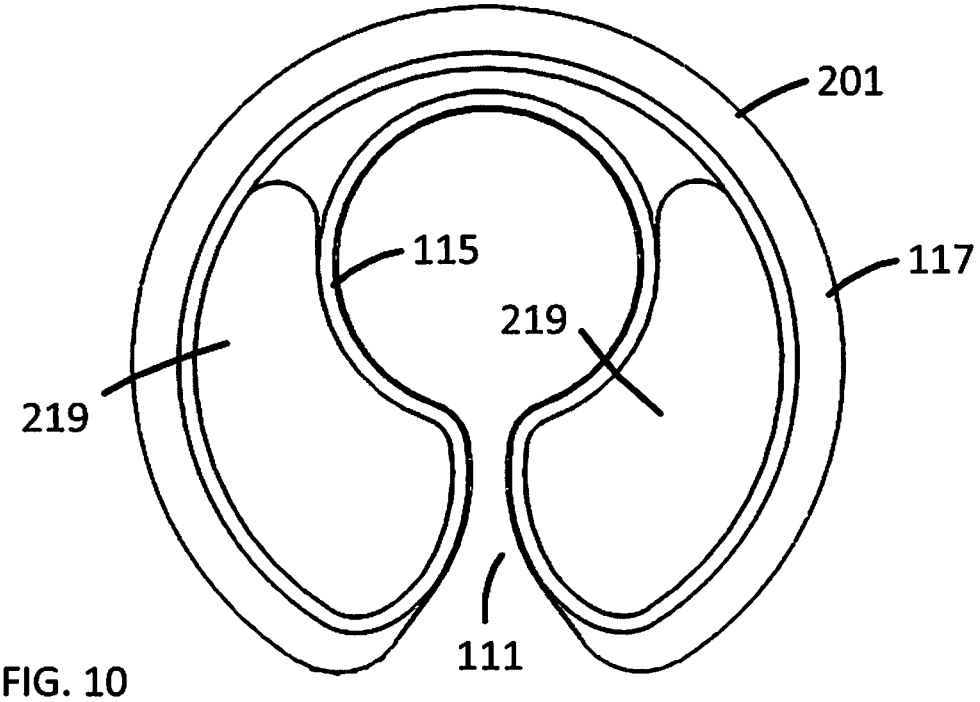
FIG. 10 illustrates a front view of a hollow embodiment of the hanger spacer.
Figure 11:
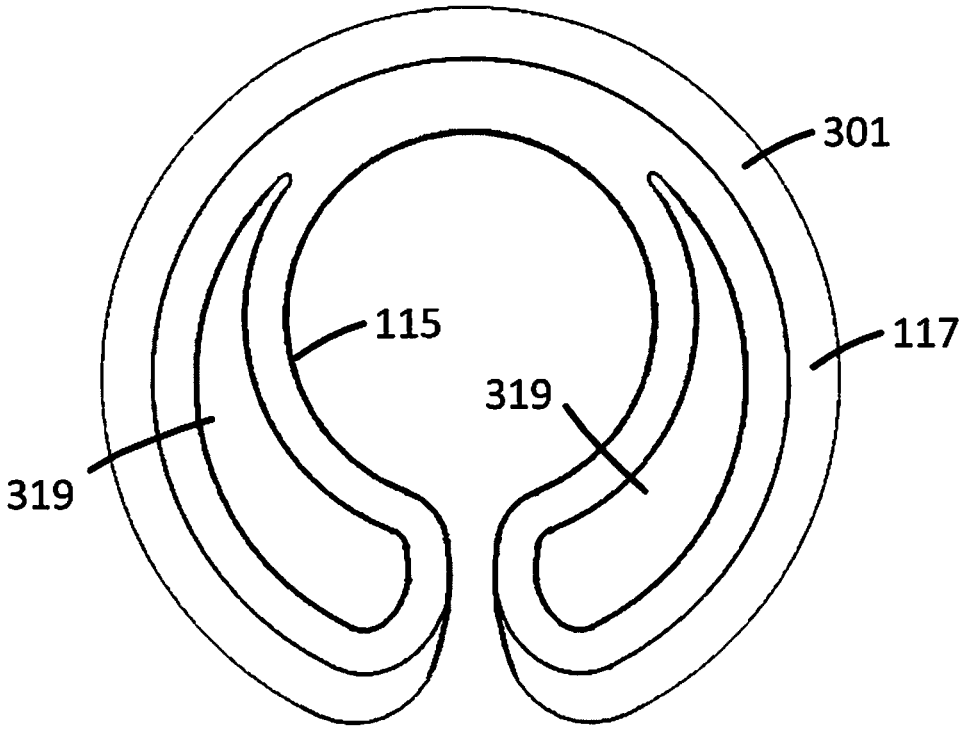
FIG. 11 illustrates a front view of an embodiment of the hanger spacer with cutout sections.

FIGS. 9 and 10 illustrate another embodiment of the hanger spacer 201. In this embodiment, the hanger spacer 201 has cutout sections 219 on the middle and lower portions. Like the embodiment illustrated in FIGS. 7 and 8, the side surfaces of the hanger spacer 201 can be planar. The outer perimeter surface 117 can be a convex curved surface that extends between the side surfaces. The hanger spacer 201 can be made of an elastic plastic material. In this embodiment, the lower portions of the hanger spacer 201 can be more flexible than the top portion of the hanger spacer 201. Thus, when the hanger spacer 201 is placed on a clothes rod, the lower portions of the hanger spacer 201 can deform outward and allow the slot 111 to expand in width so that the hanger spacer 201 can be placed around the clothes rod. With reference to FIG. 11 another embodiment of a hanger spacer 301 is illustrated. The illustrated embodiment is similar to the embodiment illustrated in FIGS. 9 and 10. In this embodiment, the cutout sections 319 are narrower in width and the cutout sections 319 extend through a larger portion of the hanger spacer. The cutout sections 319 can reduce the volume of material needed to build the hanger spacer 301 without reducing the functional performance. The hanger spacer 319 can be made of molded plastic or foam.

In other embodiments, the hanger spacer can have various other configurations. For example, with reference to FIGS.

Figure 12:
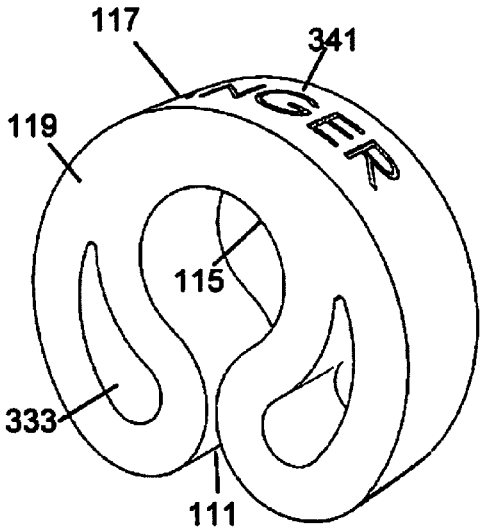
FIGS. 12 and 13 illustrate perspective views of hanger spacers with cutout sections.
Figure 13:
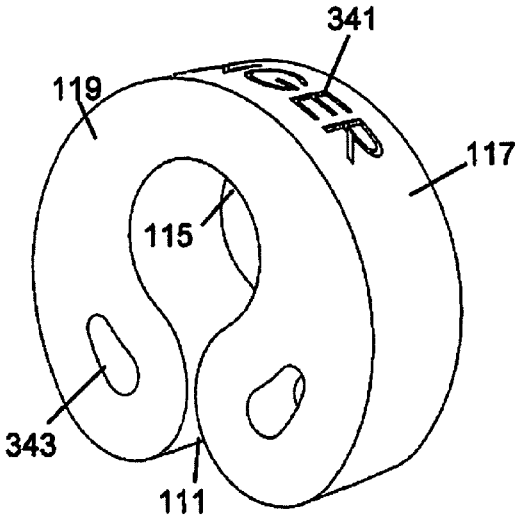

12 and 13, the illustrated embodiments of the hanger spacer 341 can be made of a die cut foam material. The hanger spacer 341 illustrated in FIG. 12 has an open space 333 that is larger than the open space 343 shown in FIG. 13. In both embodiments, the open spaces can extend through the sides and entire thickness of the hanger spacer 341 cross section. The hanger spacers 341 can be fabricated in various different ways. For example, the hanger spacers can be cut from a sheet of foam material into the illustrated shapes. In another embodiment, the hanger spacer 341 can be made from an extruded piece of foam having a cross section that matches the cross section of illustrated the hanger spacers 341. The hanger spacer extrusion can then be cut into the individual hanger spacers 341 at the desired thicknesses that define the side surfaces 119. In some embodiments, the hanger spacer extrusion can be cut with a hot wire that melts the foam to cut the extrusion. In other embodiments, a saw or blade can be used to cut the extrusion into the desired thicknesses. The cuts can be cut at a perpendicular angle to the axis of the extrusion or perpendicular angle to the sheet material. If the side surfaces 119 are rough after being cut, additional processing can be performed to create a smooth surface. For example, the side surface 119 can be pressed against a hot surface to melt the foam and create a smooth finished surface.

The foam material can be marked with lettering or any other markings. In the illustrated examples, the upper outer surface 117 of the hanger spacer is marked with a plurality of letters. Melting the foam can create recesses that form the markings such as debossed letters. Alternatively, the markings can be printed with ink or adhesive letters attached to the outer surface 117 or side surface 119.

Figure 14:
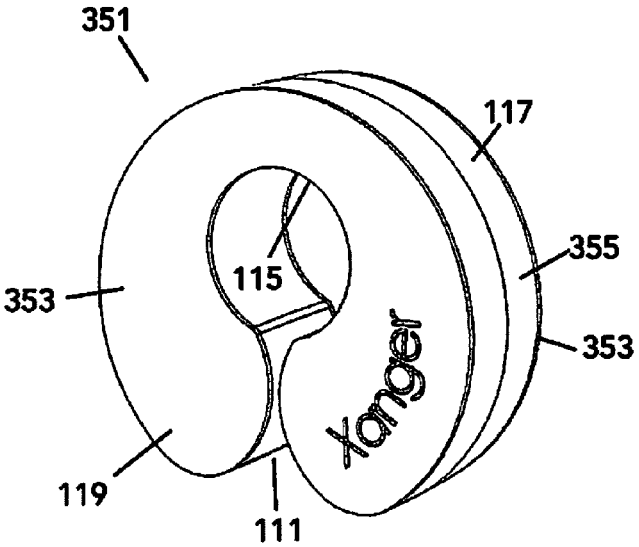
FIG. 14 illustrates a perspective view of an embodiment of the hanger spacer with laminated side surface pieces.

With reference to FIG. 14, the hanger spacer can be made of a plurality of materials. In the illustrated embodiment, the main body 355 of the hanger spacer 351 can be made of a foam material and the sides 119 of the hanger spacer can be laminated with a harder material 353 such as plastic. The laminated side materials 353 can be marked with various ornamental designs. In an embodiment, the hanger spacers described above with reference to FIGS. 12 and 13 can be used to form the inner foam piece sandwiched between the side materials. The markings can be applied through various means such as silk screening, painting, material pigments or any other marking methods.

Figure 15:
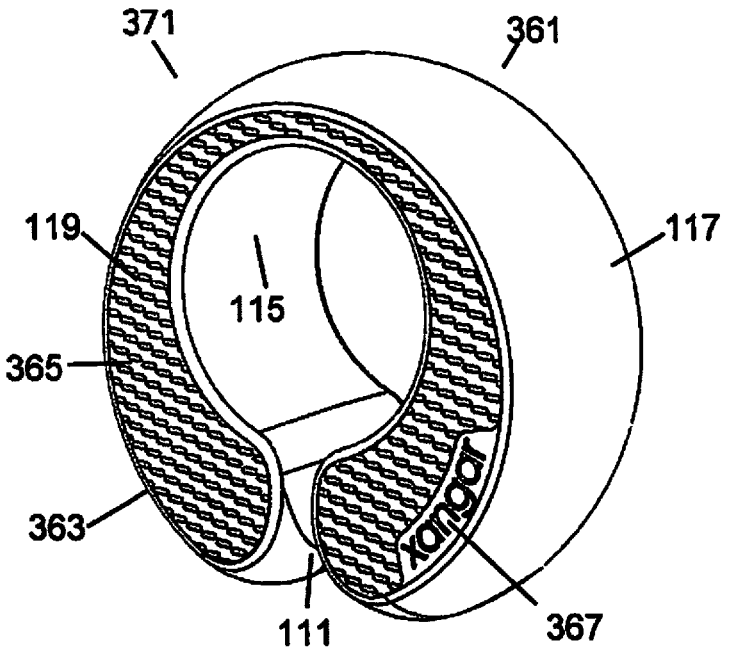
FIG. 15 illustrates a perspective view of an embodiment of the hanger spacer with multiple material pieces.

With reference to FIG. 15, multiple types of foam can be used to fabricate an embodiment of the hanger spacer 371. In this example, the inner perimeter surfaces 115 and outer perimeter surfaces 117 can be formed from a first material 363 such as polypropylene foam and the interior portions 365 of the hanger spacer can be formed from a second material 365 which can be a different foam material. In this example, the exterior material 363 which can be the first rim foam can have a lighter color than the interior second material 365 which can be a second foam material. In this embodiment, the hanger spacer 371 can be formed in a mold or molds. For example, the exterior rim portion can be created in a first mold and the interior portion can be created in a second mold. These two components 363, 365 made of different materials can then be combined and fused with heat melting or an adhesive or any other coupling means. The surfaces can be textured and/or marked with text or ornamental patterns. These textured and patterned surfaces can be features of the molds.

Figure 16:
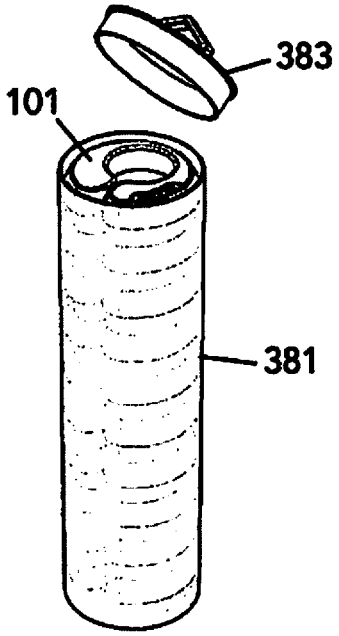
FIG. 16 illustrates a container for packaging sets of hanger spacers.

FIG. 16 illustrates an embodiment of the hanger spacer container 381. The hanger spacers 101 stored in the hanger spacer container 381 can be circular in shape and the hanger spacers 101 can be packaged in a tubular container 381. In this example, the hanger spacers 101 can have a thickness that is about 1.5 inches. The length of the hanger spacer container 381 can proportional to the number of hanger spacers that are going to be stored. For example, an 18-inch long tubular structure may hold 12 hanger spacers 101 that are each 1½ inches thick. In other embodiments, the container 381 can be variable to hold any desired number of hanger spacers 101. The hanger spacer container 381 can be a transparent or translucent structure so that the hanger spacers 101 can be seen. A circular lid 383 can fit on the top of the hanger spacer container 381. The lid can include a hook for holding the hanger spacer container 381 on a display.

Figure 17:
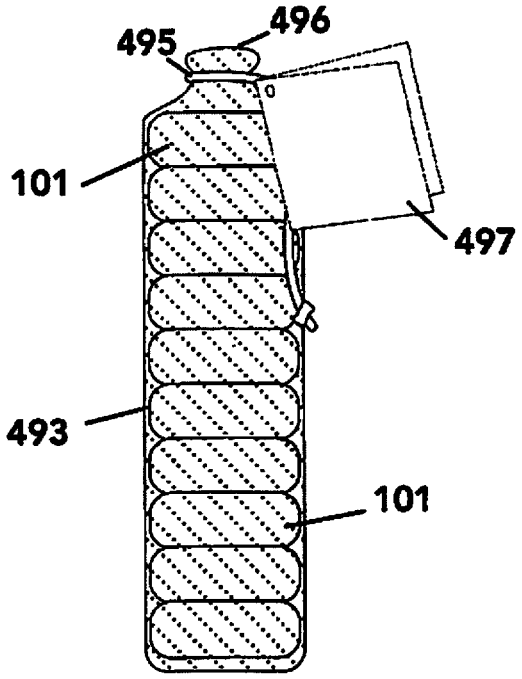
FIG. 17 illustrates a tubular bag for packaging sets of hanger spacers.
Figure 18:
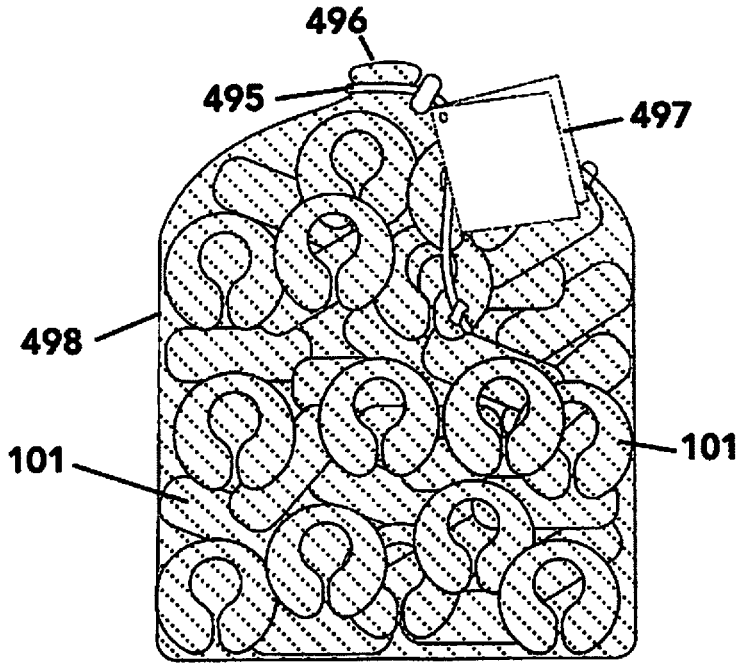
FIG. 18 illustrates a bulk bag for packaging hanger spacers.

FIG. 17 illustrates a tubular bag 493 that can be used to package a set of hanger spacers 101 is an aligned orientation. The tubular bag 493 can have an open top 496 through which hanger spacers 101 can be inserted and removed from the tubular bag 493. A tie 495 can be used to close the open top 496 of the tubular bag 493 to keep the hanger spacers 101 in place. The tubular bag can be made of a mesh, transparent, translucent material, or other suitable materials. With reference to FIG. 18, a bulk bag 498 that includes hanger spacers 101 stored in a random bulk manner. The bulk bag 498 can have a much wider cross section than the tubular bag 493. Again, the tie 495 can be used to close the open top 496 to keep the hanger spacers 101 in the bulk bag 498. For the illustrated embodiments, the tie 495 can be a string, ribbon, cord, rope, zip tie or any other suitable fastener. The tie 495 can also be secured to an additional piece 497 which can be a card, a hangtag, a label or any other attachent.

Figure 19:
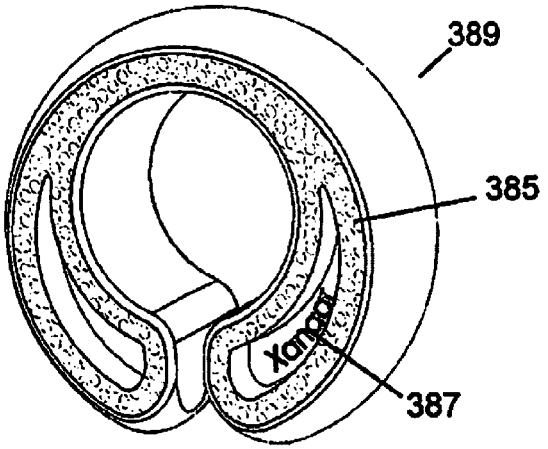
FIG. 19 illustrates a perspective view of an embodiment of the hanger spacer with recessed areas.
Figure 20:
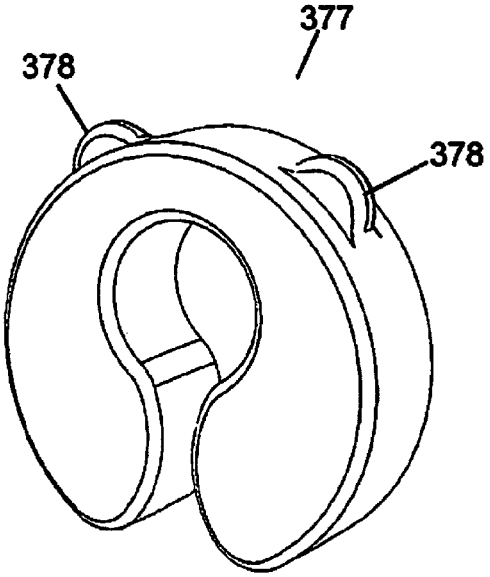
FIG. 20 illustrates a perspective view of an embodiment of the hanger spacer with ornamental ears.
Figure 21:
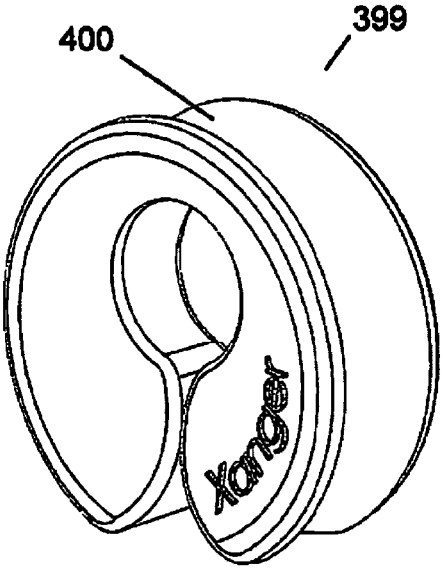
FIG. 21 illustrates a perspective view of an embodiment of the hanger spacer with a concave outer surface.
Figure 22:
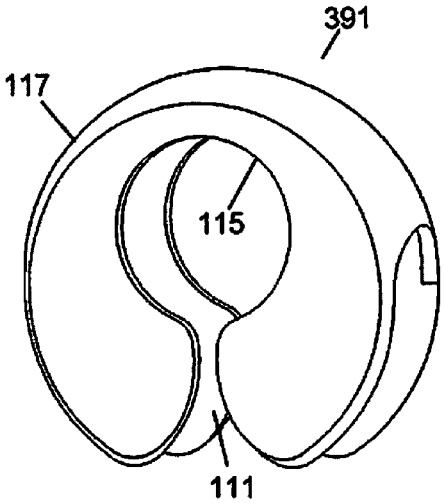
FIG. 22 illustrates a perspective front view of a hollow embodiment of the hanger spacer.
Figure 23:
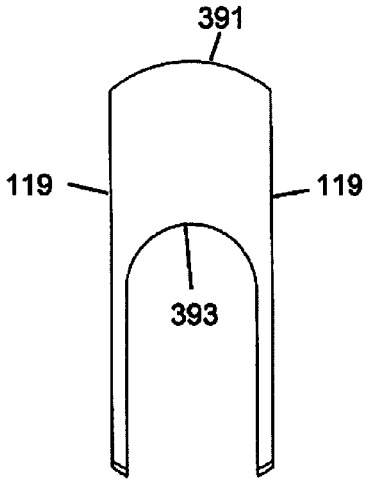
FIG. 23 illustrates a side view of a hollow embodiment of the hanger spacer.
Figure 24:
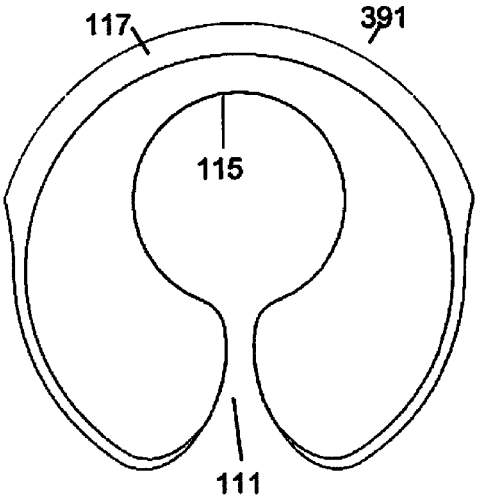
FIG. 24 illustrates a front view of a hollow embodiment of the hanger spacer.
Figure 25:
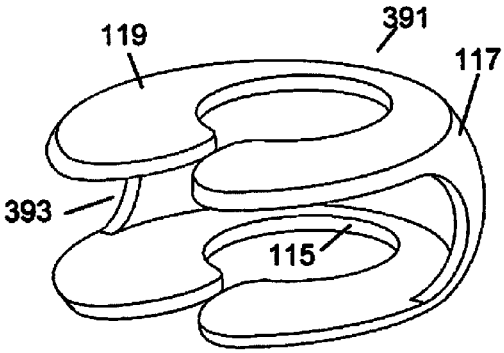
FIG. 25 illustrates a perspective side view of a hollow embodiment of the hanger spacer.

FIGS. 19-21 illustrate different embodiments of hanger spacers with different ornamental features. FIG. 19 illustrates an embodiment of the hanger spacer 389 with textured side surfaces 385 and recessed molded pockets 387 that can include a logo within the recessed space. With reference to FIG. 20, an embodiment of the hanger spacer 377 is illustrate with ornamental ears 378 extending from the outer surface of the hanger spacer 377. With reference to FIG. 21, the hanger spacer 399 can have an outer surface 400 that is concave between the side surfaces so that the diameter of the hanger spacer 399 is smaller at the center cross section than at the side sections. In theses embodiment, the interior circular surfaces can be smooth which can help the hanger spacers to rotate and slide freely on the clothes rod.

FIGS. 22-25 illustrate an embodiment of a hanger spacer 391 that has a substantially hollow construction. In this configuration, the hanger spacer 391 can have solid structural surfaces on the upper 391 and sides surfaces 119 while the lower, inner concave surfaces 393 and tapered slot 111 are hollow and open. The side surfaces 119 can be substantially similar in shape to cross sections of the other hanger spacers. The side surfaces 119 have a circular outer diameter, an inner concave surface 115 that has a diameter that is larger than the clothes rod and a tapered slot 111 that extends between the outer diameter 117 and the inner concave surface 115. Because the hanger spacer 391 has open edge portions, the lower outer surface, inner concave surface and tapered slot are defined by the edges of side surfaces 119.

The hanger spacer 391 can function in the same way described with reference to the other embodiments. The bottom opening of the tapered slot 111 can be pressed against the clothes rod and the tapered slot 111 can expand until the clothes rod is adjacent to the inner concave surface 115. To remove the hanger spacer from the clothes rod, the user can twist the hanger spacer 391 structure so that the clothes rod is pushed through the tapered slot 111 until it is removed.

Figure 26:
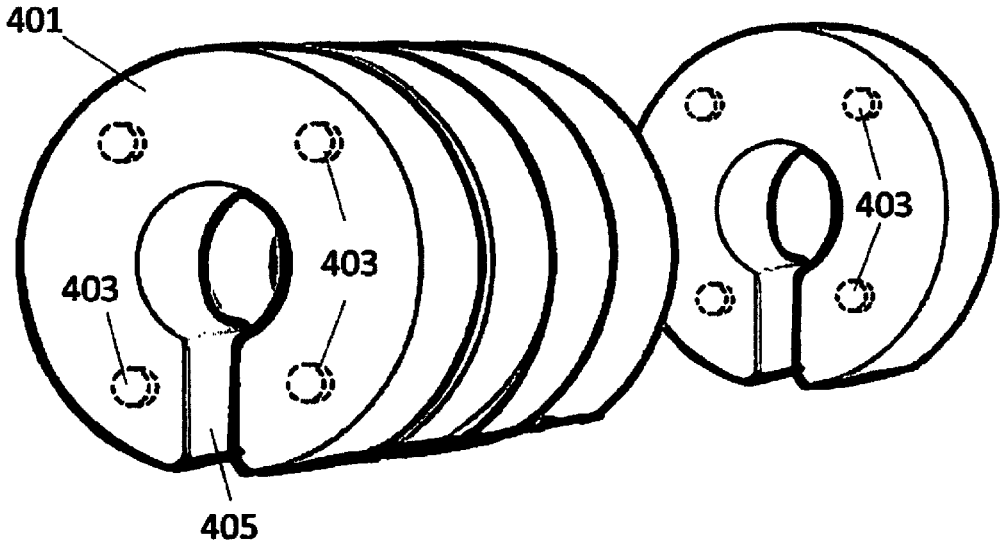
FIG. 26 illustrates a perspective view of a plurality of hanger spacers with magnets for connecting or repelling adjacent hanger spacers on a clothing rod.

As discussed, the spacing requirements can vary depending upon the clothing thicknesses. For example, a thicker article of clothing such as a coat can require more space than a thinner article of clothing such as a thin material shirt. In some embodiments, thicker hanger spacers can be used. However, in other embodiments, it can be possible to couple multiple hanger spacers so that multiple hanger spacers can be coupled and placed between the adjacent hangers on a clothes rod. With reference to FIG. 26, an embodiment of the hanger spacers 401 can have one more magnets 403 embedded within the side surfaces. In some embodiments, the magnets 403 can be recessed so that both side surfaces are smooth and planar. However, in other embodiments, the magnets can be placed on the outer side surfaces. The polarity of the magnets 403 can be configured so that the hanger spacers 401 can be coupled to each other with their slots 405 aligned with each other. In an embodiment, the magnets 403 on the opposite side surfaces of the hanger spacer 401 are oriented with their polarities in the same direction so that the +− polarity of magnets on a first side and second side are the same. Also, the magnets of the hanger spacers 401 should be positioned at the same locations on the hanger spacer 401 side surfaces in a symmetric pattern relative to a vertical axis so that the magnets of the adjacent hanger spacers 401 are aligned when hanger spacers 401 are vertically oriented.

The adjacent hanger spacers 401 can either be attached or repulsed depending upon the magnet orientations. A user can place attracted hanger spacers 401 next to each other when more space is needed between hangers. Alternatively, the polarities of the magnets 403 of hanger spacers 401 can be set to be repulsive at areas where clothing hangers will be placed. The repulsive forces can be useful because they can be used create spaces between the hanger spacers 401 which will inherently move away from each other on a clothing rod making it easier to place hangers spaces between hanger spacers 401 on the clothing rod. In an embodiment, the hanger spacer 501 can be marked so that the user knows which sides will be attracted and which will repel.

Figure 27:
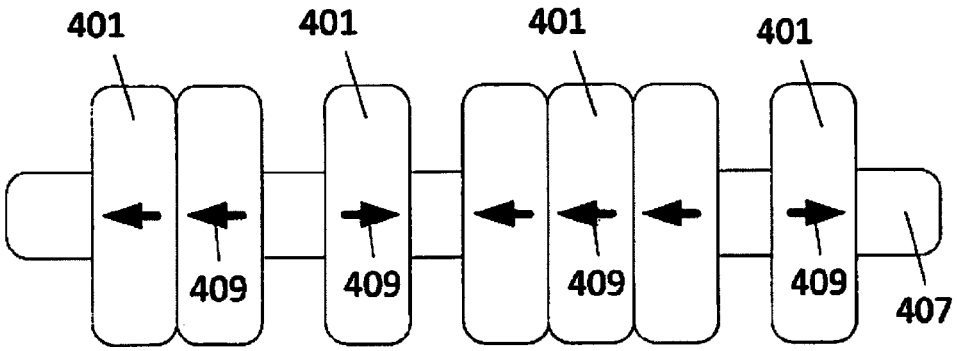
FIG. 27 illustrates a top view of a plurality of hanger spacers with magnets for connecting or repelling adjacent hanger spacers on a clothing rod.

With reference to FIG. 27, a clothes rod 407 is illustrated that includes a plurality of hanger spacers 401. The arrows 409 can represent the polarity of the magnets. The magnets with arrows 409 or magnet polarities in the same direction will tend to be coupled while the arrows 409 in opposite directions will be repelled from each other. The repelling forces can be used to create spaces between hanger spacers 401 where the clothes hangers can be placed on the clothing rod. When a clothes hanger is removed from the clothes rod 407, the hanger spacers 401 on opposite sides of the clothes hanger will not be magnetically coupled and the clothes hanger can easily be replaced on the clothes rod 407 in the same position it was before being removed.

Figure 28:
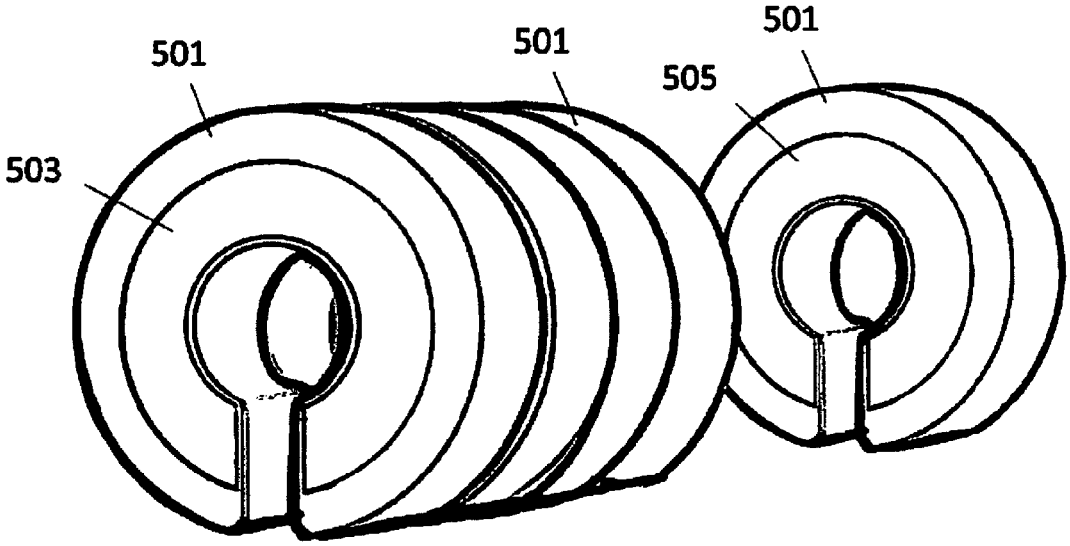
FIG. 28 illustrates a perspective view of a plurality of hanger spacers with coupling for connecting adjacent hanger spacers.

With reference to FIG. 28, an embodiment of the hanger spacer 501 is illustrated that uses a hook and loop coupling mechanism. In an embodiment, the hook material 503 can be placed on one side of the hanger spacer 501 and a loop material 505 can be placed on the opposite side. Thus, the user can press the hook material 503 to the loop material 505 to couple adjacent hanger spacers 501. However, the hook material 503 will not coupled to other hook materials 503 and the loop material 505 will not couple to other loop materials 505. In other embodiments, any other type of coupling mechanisms can be used to connect the hanger spacers 501. In an embodiment, the hanger spacer 501 can be marked so that the user knows which sides can be coupled together and which sides will not.

Figure 29:
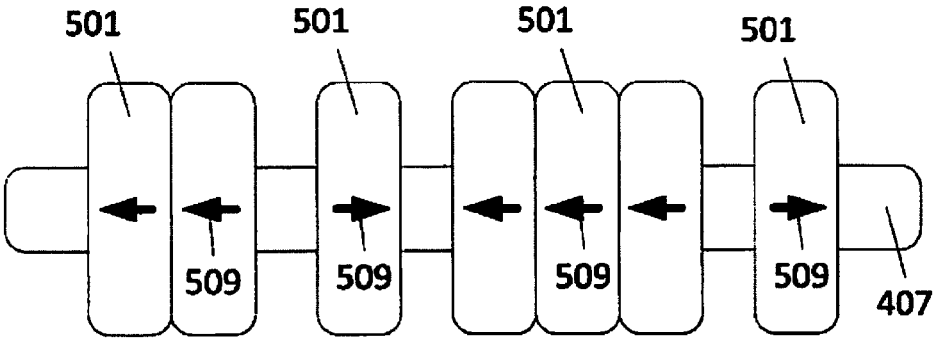
FIG. 29 illustrates a top view of a plurality of hanger spacers with couplings for connecting or not connecting adjacent hanger spacers on a clothing rod.

With reference to FIG. 29, a clothes rod 407 is illustrated with a plurality of hanger spacers 501 with the arrows 501 representing the hook material 503 and loop material 505 sides of the hanger spacer 501. In the example, the arrows 501 point towards the hook material 503 side of the hanger spacers 501 and away from the loop material 505 side. The coupling of the hook materials 503 and the loop materials 505 can couple adjacent hanger spacers 501 when intended and prevent the hanger spacers from being accidentally coupled when hangers are removed from the clothes rod 407. The user can place the hanger spacers 501 on the clothing rod with the hook surfaces 503 or the loop surfaces 505 facing each other in the areas were the hangers are going to be placed on the clothing rod.

Figure 30:
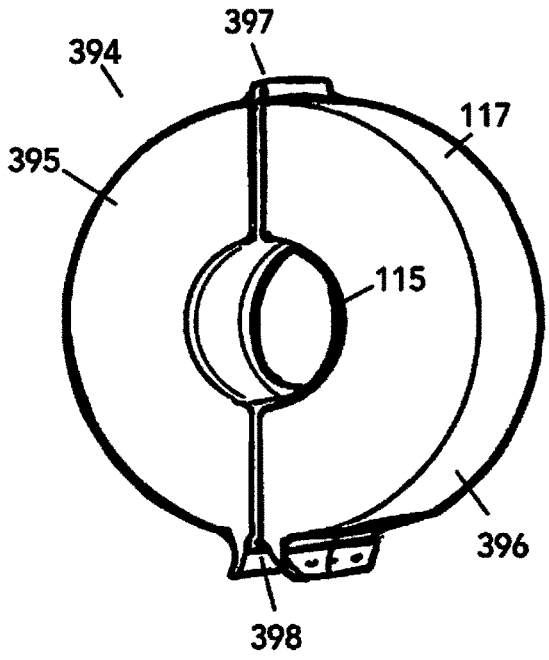
FIG. 30 illustrates a perspective view of a two piece hanger spacer in the closed position.
Figure 31:
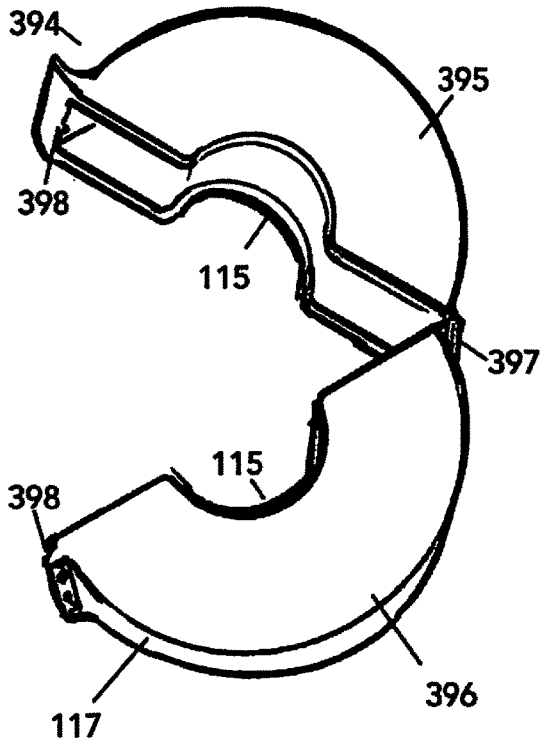
FIG. 31 illustrates a perspective view of a two piece hanger spacer in an open position.

With reference to FIGS. 30 and 31, another embodiment of the hanger spacer 394 has a configuration that can be opened and then closed to completely surround the clothes rod. In this embodiment, the hanger spacer 394 can have molded or fabricated as a single piece which has a first side 395 and a second side 396. The first side 395 and the second side 396 are coupled on one side by a hinge 397 and on the opposite side by a connector 398. With reference to FIG. 31, the hanger spacer 394 can be opened so that it can be placed with the internal surfaces 115 around a clothing rod. With reference to FIG. 30 the hanger spacer 394 can be closed with the connector 398 fastened so that the hanger spacer 394 will not fall off the clothing rod. In an embodiment, the hanger spacer 394 can be made of molded plastic and the hinge 397 can be living hinge which is a thinner flexible piece of plastic. In other embodiments, the side 395 and the second side 396 can be separate pieces that are formed separately and secured to the hinge 397 and connector 398. The plastic or foam material may provide the visible eternal surfaces while the interior volume can be hollow to reduce the volume of material needed for the hanger spacer.

Figure 32:
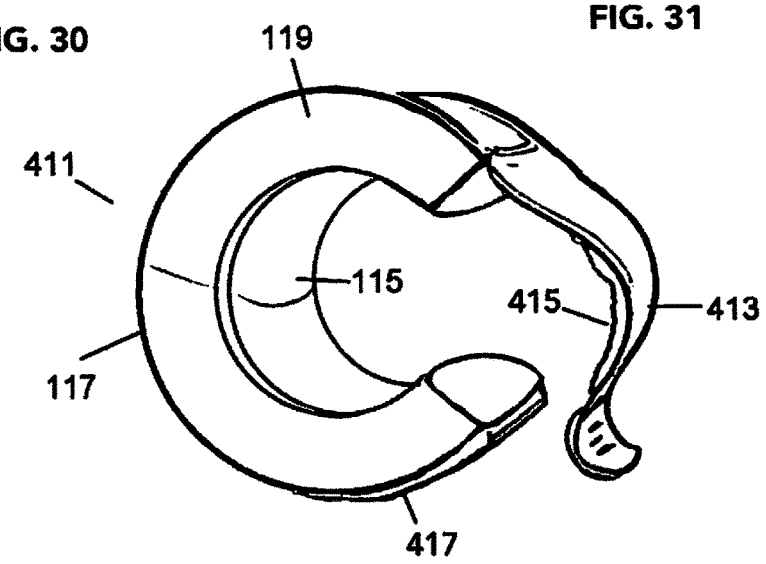
FIG. 32 illustrates a perspective view of a hanger spacer with a closure strap.

With reference to FIG. 32, another embodiment of a hanger spacer 411 is illustrated. The hanger spacer 411 can have an open body design so that the clothing rod can be placed in the opening. A strap 413 can be permanently connected to one side of the opening of the hanger spacer 411. The opposite end of the strap 413 can have a fastener such as a hook 417 and loop 415 connector. After the hanger spacer 411 is placed with the internal surfaces 115 around a clothing rod the strap 413 can be fastened to the opposite side of the opening to prevent the hanger spacer 411 from falling off the clothing rod.

Figure 33:
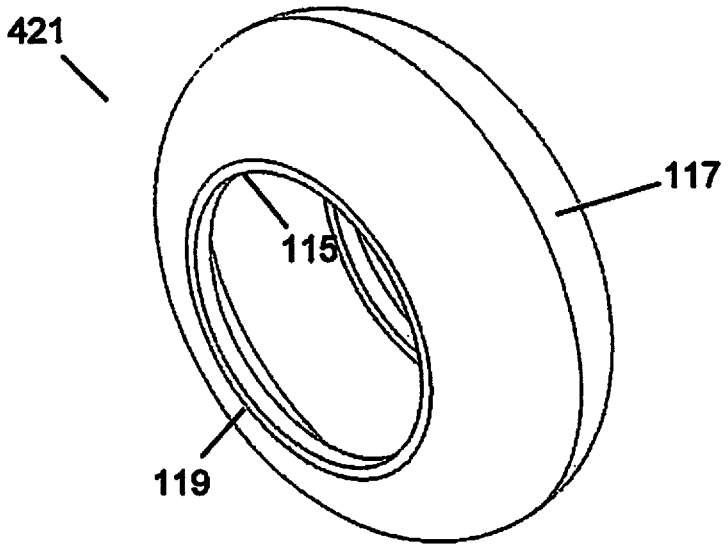
FIG. 33 illustrates a perspective view of a circular closed hanger spacer.

With reference to FIG. 33, another embodiment of a closed annular hanger spacer is illustrated. In this embodiment, the hanger spacer is a ring that does not have an opening or a hinge. The annular hanger spacer can be placed over an end of the clothes rod and may require removing the clothes rod from the mounting hardware when the hanger spacers are added or removed from the clothes rod. The plastic or foam material may provide the visible eternal surfaces while the interior volume can be hollow to reduce the volume of material needed for the hanger spacer.

Figure 34:
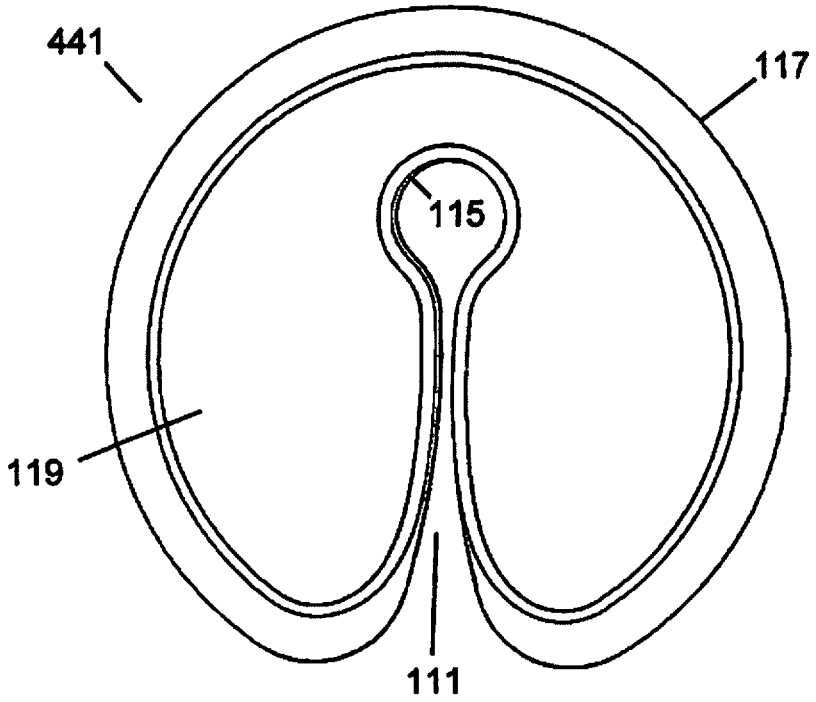
FIG. 34 illustrates a front view of an embodiment of a hanger spacer having a smaller hole for smaller cross section clothing support.
Figure 35:
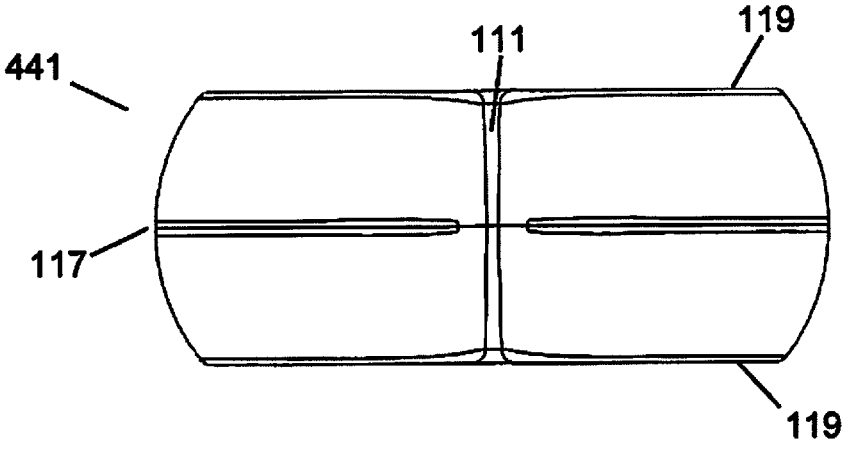
FIG. 35 illustrates a bottom view of an embodiment of a hanger spacer having a smaller hole for smaller cross section clothing support.
Figure 36:
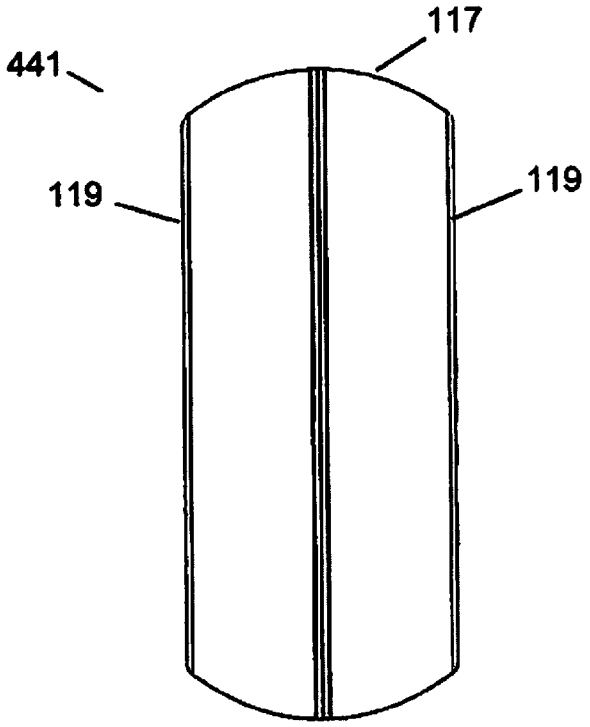
FIG. 36 illustrates a side view of an embodiment of a hanger spacer having a smaller hole for smaller cross section clothing support.
Figure 37:
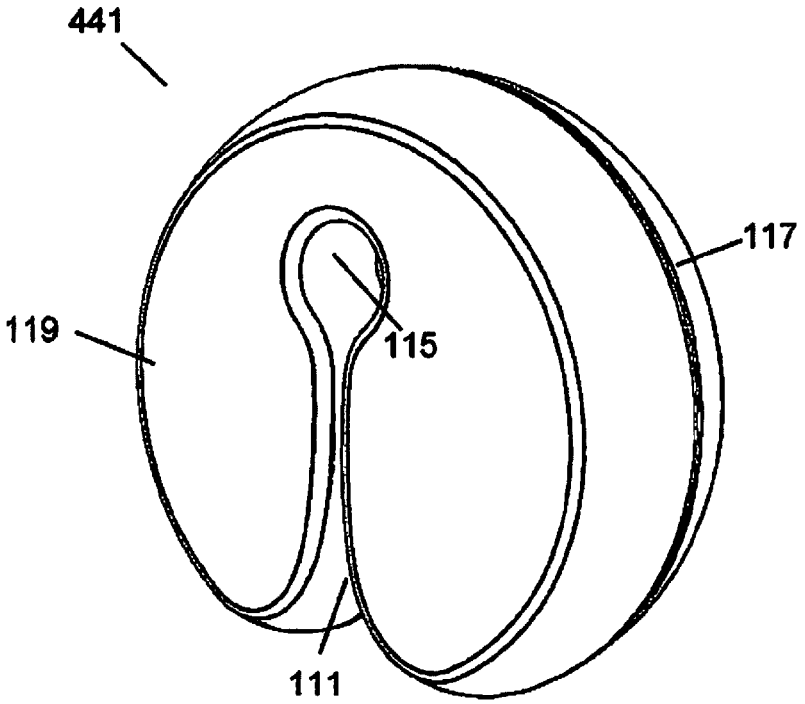
FIG. 37 illustrates a perspective view of an embodiment of a hanger spacer having a smaller hole for smaller cross section clothing support.

Although the hanger spacers have been described as being used with clothing rods, in other embodiments, the hanger spacers an be configured for use with clothing wires, clothing cable or thin clothing rods which have a much smaller diameter than normal clothing rods. The smaller inner diameter improves the functionality of the hanger spacer since the larger inner diameter hanger spacer will not fit well onto a thing support wire or cable. FIGS. 34-37 illustrate an embodiment of a smaller support hanger spacer 441. In order to work properly with these narrower diameter structures, the inner surface 115 of the clothing spacer 441 has a smaller diameter which can be about 0.1 to 0.5 inch. The slot 111 is also longer than the larger diameter clothing rod embodiments. FIG. 34 illustrates a front view of the hanger spacer 441 with a side surface 119 and an outer diameter 117. FIG. 35 illustrates a bottom view which shows the slot 111, side surfaces 119 and outer surface 117. FIG. 36 illustrates a side view and FIG. 37 illustrates a perspective view of the hanger spacer 441.

Figure 38:
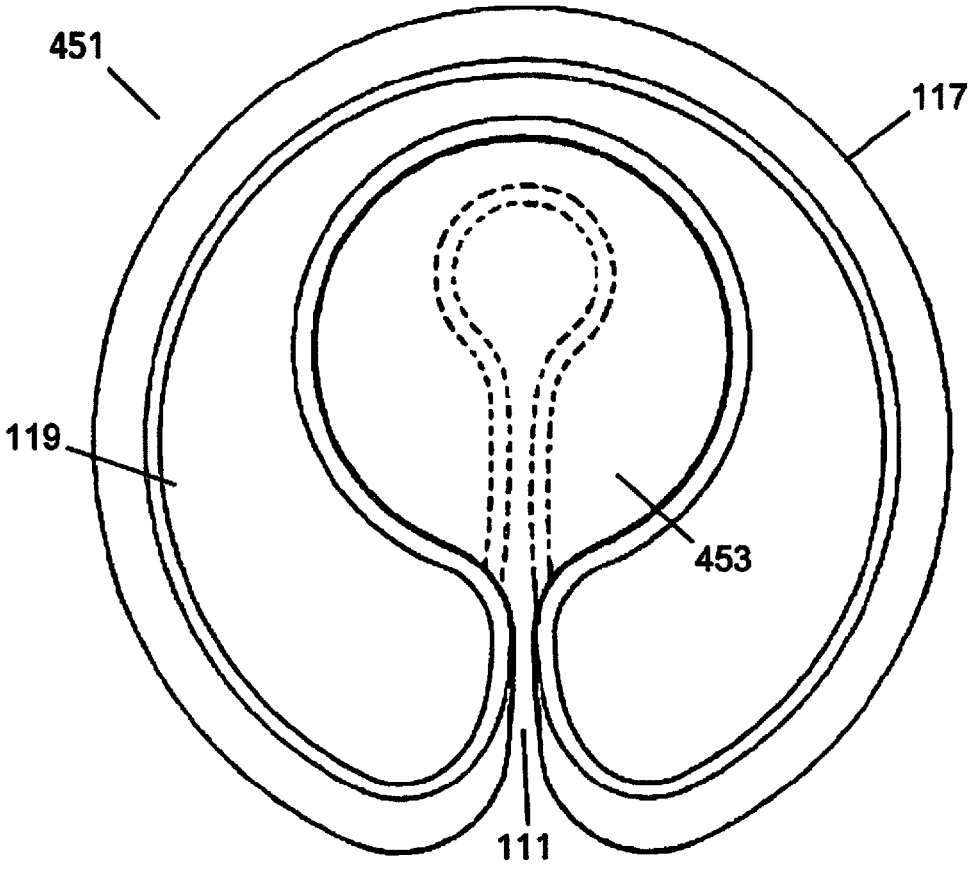
FIG. 38 illustrates a front view of an embodiment of a hanger spacer with an insert with a smaller hole placed in the hole of the hanger spacer.
Figure 39:
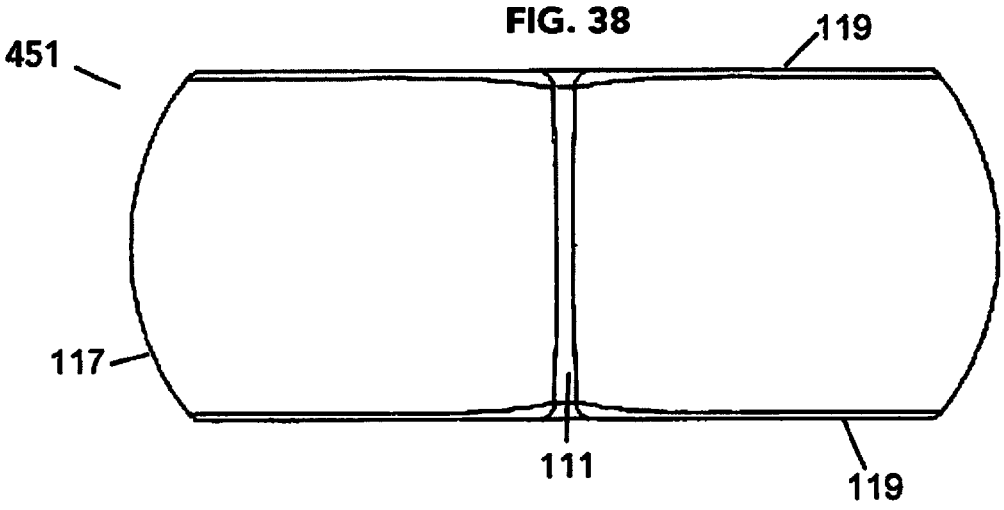
FIG. 39 illustrates a bottom view of an embodiment of a hanger spacer with an insert with a smaller hole placed in the hole of the hanger spacer.
Figure 40:
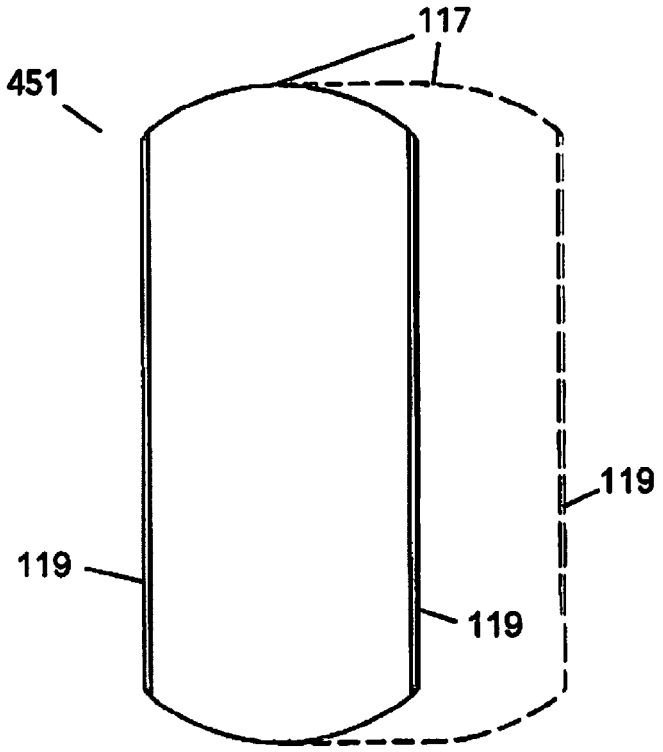
FIG. 40 illustrates a side view of a hanger spacer illustrating variable thicknesses of the hanger spacer.
Figure 41:
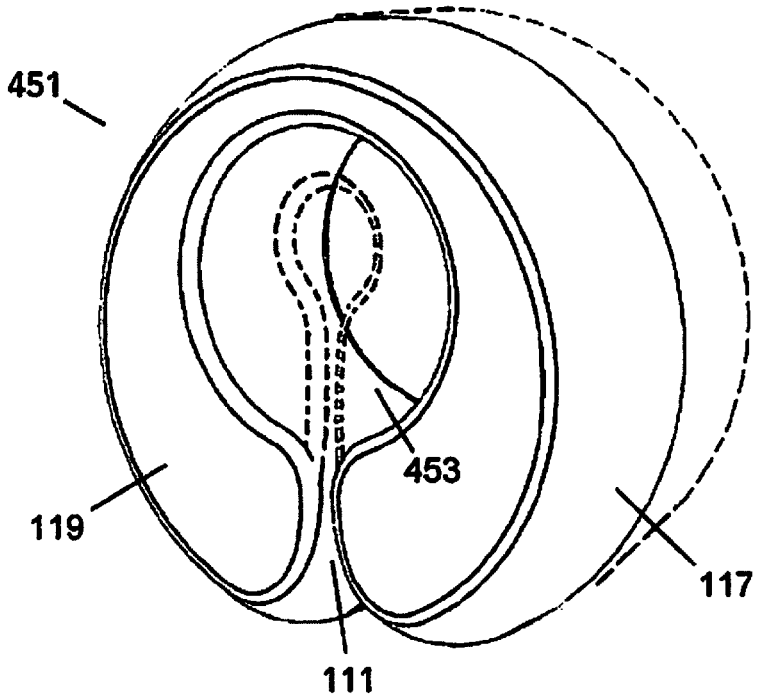
FIG. 41 illustrates a perspective view of a hanger spacer illustrating an insert with a smaller hole placed in the hole of the hanger spacer and variable thicknesses of the hanger spacer.

In some embodiments with reference to FIGS. 38-39, the hanger spacer 451 can have an insert 453 that fits within the hanger spacer 451 so that the inner diameter will more closely match the diameter of the clothing wire or cable. In an embodiment, the insert 453 can have an outer diameter that is matches or is slightly larger than the inner diameter of the hanger spacer 451 so that there will be a snug or interference fit which can securely couple the insert 453 in the hanger spacer 451. FIG. 38 illustrates a front view and FIG. 39 illustrates a bottom view. FIGS. 40 and 41 illustrate the variable thickness of the hanger spacer 451. FIG. 40 illustrates a side view and FIG. 41 illustrates a perspective view of the hanger spacer 451 with the solid lines representing a narrower embodiment, and the dashed lines representing a wider embodiment.

Figure 42:
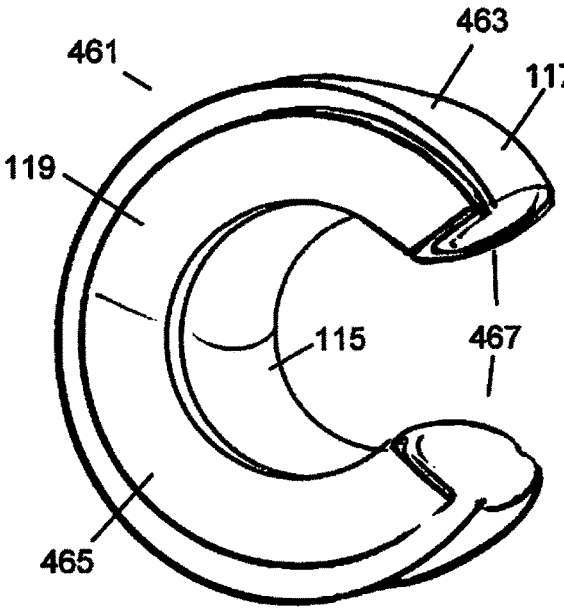
FIG. 42 illustrates a perspective front view of a two piece hanger spacer in the open configuration.
Figure 43:
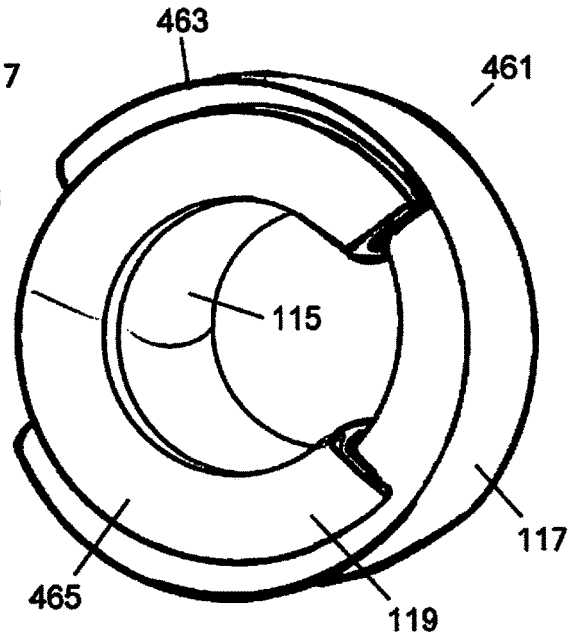
FIG. 43 illustrates a perspective front view of a two piece hanger spacer in the closed configuration.

FIGS. 42 and 43 illustrates another embodiment of a two piece hanger spacer 461 having an inner circular structure 465 with an opening 467 and an outer circular structure 463. The inner circular structure 465 and the outer circular structure 463 can have a concentric rotary closure. FIG. 42 illustrates the inner structure 465 and the outer structure 463 with the opening 467 aligned so that the hanger spacer 461 can be placed on a clothing rod. Once the hanger spacer 461 is placed on the clothing rod, the outer structure 463 can be rotated to span across the opening 467 so that the hanger spacer 461 cannot fall of the clothing rod.

Figure 44:
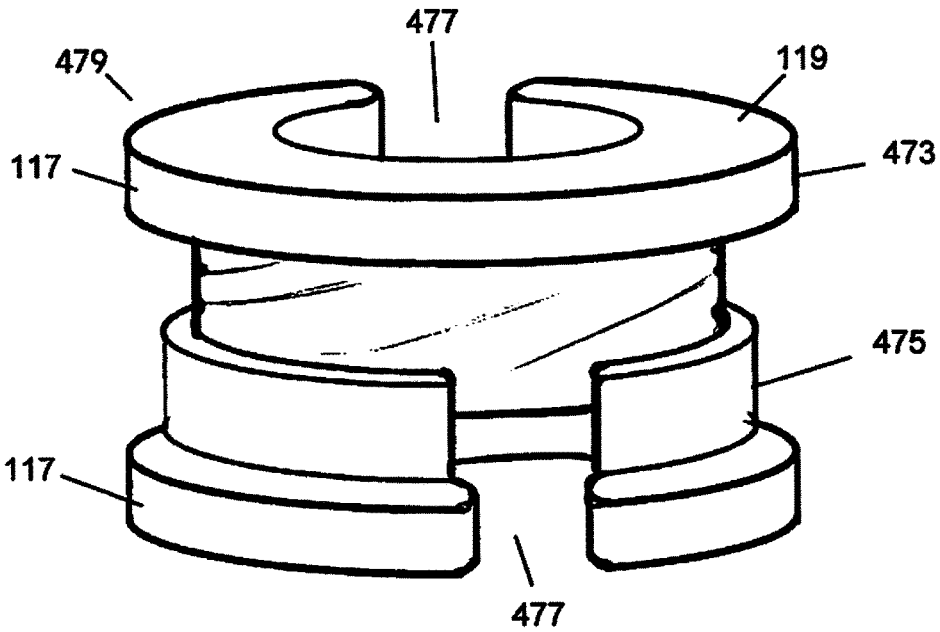
FIG. 44 illustrates a perspective side view of a two piece hanger spacer in the closed configuration.

FIG. 44 illustrates another two piece hanger spacer 479 embodiment that has a first piece 473 with an opening 477 and a second piece 475 with an opening 477. Like FIGS. 42 and 43, the first piece 473 and a second piece 475 can have a concentric rotary closure. In the illustrated embodiment, an outer diameter of a cylindrical surface of the first piece 473 fits within an inner diameter of the second piece 475. The openings 477 can be aligned so that the hanger spacer 479 can be placed on the clothing rod and the rotated so that the openings 447 are not aligned to prevent the hanger spacer 479 from falling off the clothing rod. In this embodiment, the width of the hanger spacer 479 can also be adjusted. In FIG. 44, the hanger spacer 479 is in an expanded width configuration. However, if a narrower hanger spacer 479 is desired, the first piece 473 can be pressed further into the second piece 475. In an embodiment, the adjacent outer diameter of the first piece 473 and the inner diameter of the second piece 475 can be threaded so that the adjusted by rotating the first piece 473 and the second piece 475.

In the description above and throughout, numerous specific details are set forth in order to provide a thorough understanding of an embodiment of this disclosure. It will be evident, however, to one of ordinary skill in the art, that an embodiment may be practiced without these specific details. In other instances, well-known structures and devices are shown in block diagram form to facilitate explanation. The description of the preferred embodiments is not intended to limit the scope of the claims appended hereto. Further, in the methods disclosed herein, various steps are disclosed illustrating some of the functions of an embodiment. These steps are merely examples, and are not meant to be limiting in any way. Other steps and functions may be contemplated without departing from this disclosure or the scope of an embodiment.

What is claimed is:

1. A hanger spacer placed on a clothing rod, comprising:
two planar side surfaces;
an outer perimeter surface that has an outer diameter between 1.5 to 4 inches, the outer perimeter surface has a convex curvature between the two planar side surfaces wherein an apex of the convex curvature is at a center cross section portion of the hanger spacer equidistant from the two side surfaces;
an inner concave surface extending between the two side surfaces that defines an inner diameter within the outer perimeter surface; and
a tapered slot between the outer perimeter surface to the inner concave surface that defines an angle between 30 to 80 degrees;
wherein a thickness of the hanger spacer between the two planar side surfaces is equal to or greater than 0.50 inch and the inner diameter is between 0.62 inch and 1.32 inch and larger than an outer diameter of the clothing rod that the hanger spacer is placed on and the hanger spacer rotates freely on the clothing rod.

2. The hanger spacer of claim 1 wherein the hanger spacer has a "C" shape cross section and ends of the hanger spacer have rounded corners and a radius of the rounded corners is 0.25 to 0.75 inch.

3. The hanger spacer of claim 1 wherein a center of gravity of the hanger spacer is lower than a geometric center of the hanger spacer.

4. The hanger spacer of claim 1 wherein at least a portion of the hanger spacer is made of an elastic plastic material.

5. The hanger spacer of claim 1 wherein at least a portion of the hanger spacer is made of a foam material.

6. The hanger spacer of claim 1 further comprising:
text markings on the outer perimeter surface.

7. A hanger spacer placed on a clothing rod, comprising:
two planar side surfaces;
an outer perimeter surface that has an outer diameter between 1.5 to 4 inches, the outer perimeter surface has a convex curvature between the two side surfaces wherein an apex of the convex curvature is at a center cross section portion of the hanger spacer equidistant from the two side surfaces;
an inner concave surface extending between the two side surfaces that defines an inner diameter within the outer perimeter surface; and
a tapered slot between the outer perimeter surface to the inner concave surface;
wherein a thickness of the hanger spacer between the two planar side surfaces is equal to or greater than 0.50 inch and the inner diameter is larger than an outer diameter of a clothing rod that the hanger spacer is placed on and the hanger spacer rotates freely on the clothing rod.

8. The hanger spacer of claim 7 wherein the hanger spacer has a "C" shape cross section and ends of the hanger spacer have rounded corners and a radius of the rounded corners is 0.25 to 0.75 inch.

9. The hanger spacer of claim 7 further comprising:
a hole that extends between the side surfaces.

10. The hanger spacer of claim 7 wherein the outer perimeter surface and the inner concave surface are made of a first material and the side surfaces are made of a second material that is laminated to the first material.

11. The hanger spacer of claim 7 wherein the inner concave surface is partially cylindrical.

12. The hanger spacer of claim 7 wherein a center of gravity of the hanger spacer is lower than a geometric center of the hanger spacer.

13. The hanger spacer of claim 7 wherein at least a portion of the hanger spacer is made of an elastic plastic material.

14. The hanger spacer of claim 7 wherein at least a portion of the hanger spacer is made of a foam material.

15. The hanger spacer of claim 7 further comprising:

text markings on the outer perimeter surface.

16. A method using a hanger spacer comprising:

providing the hanger spacer having two planar side surfaces, an outer perimeter surface that has an outer diameter between 1.5 to 4 inches, the outer perimeter surface has a convex curvature between the two planar side surfaces, an inner concave surface extending between the two side surfaces that defines an inner diameter within the outer perimeter surface and a tapered slot at a bottom portion of the hanger spacer wherein the outer perimeter surface is a convex curvature between the two planar side surfaces wherein an apex of the convex curvature is at a center cross section portion of the hanger spacer equidistant from the two side surfaces;

positioning the tapered slot of the hanger spacer against a clothes rod with the inner concave surface parallel to the clothes rod;

pressing the hanger spacer against the clothes rod;

expanding a width of the tapered slot;

elastically deforming the hanger spacer; and moving the clothes rod through the tapered slot to the inner concave surface wherein the inner diameter is larger than an outer diameter of the clothing rod that the hanger spacer is placed on and the hanger spacer rotates freely on the clothing rod.

17. The method of claim 16 wherein the hanger spacer has a "C" shape cross section.

18. The method of claim 16 further comprising:

twisting the hanger spacer to expand the width of the tapered slot;

moving the clothes rode through the tapered slot; and removing the hanger spacer from the clothes rod.

19. The method of claim 16 wherein the tapered slot at a bottom portion of the hanger spacer defines an angle between 30 to 80 degrees.

20. The method of claim 16 wherein the hanger spacer has a "C" shape cross section and ends of the hanger spacer have rounded corners and a radius of the rounded corners is 0.25 to 0.75 inch.

* * * * *